United States Patent [19]

Huang

[11] Patent Number: 5,003,644

[45] Date of Patent: Apr. 2, 1991

[54] TWO-STAGE WATER DISCHARGE MECHANISM FOR FLUSH TOILET TANK

[76] Inventor: Chin-Ming Huang, No. 47, Lu Her Road Sec. 1, Lu Kang Chen, Changhua Hsien, Taiwan

[21] Appl. No.: 466,525

[22] Filed: Jan. 17, 1990

[51] Int. Cl.[5] ..... E03D 1/14; E03D 3/12

[52] U.S. Cl. ..... 4/324; 4/325; 4/326; 4/393; 4/415

[58] Field of Search ..... 4/326, 327, 325, 415, 4/411, 413, 412, 661, 324, 392, 393, 378, 405

[56] References Cited

U.S. PATENT DOCUMENTS

| | | | |
|---|---|---|---|
| 2,351,672 | 6/1944 | Engel | 4/326 |
| 2,803,833 | 8/1957 | Charest | 4/326 |
| 3,768,103 | 10/1973 | Robinson | 4/326 |
| 4,172,299 | 10/1979 | del Pozo | 4/326 |
| 4,175,295 | 10/1979 | Cameron | 4/327 |
| 4,485,501 | 12/1984 | Kloner | 4/325 X |
| 4,882,793 | 11/1989 | Thompson | 4/325 X |

*Primary Examiner*—Henry K. Artis

*Attorney, Agent, or Firm*—Browdy and Neimark

[57] ABSTRACT

An improved two-stage controllable water discharge mechanism for flush toilet tank, and especially with the type having two float valves, an upper one and a lower one, wherein either the upper valve can be selectively opened or both can be simultaneously operated by simply actuating a couple of control buttons so as to vary the volume of water discharged from a cistern in consideration of economizing the use of water.

3 Claims, 6 Drawing Sheets

TWO-STAGE WATER DISCHARGE MECHANISM FOR FLUSH TOILET TANK

FIELD OF THE INVENTION

The present invention is related to an improved 2-stage, water discharge mechanism suitable to be applied to a conventional flush toilet tank for effecting the control of the volume of discharged water from the tank at two stages so as to economize the use of water used to flush the toilet bowl. The present water discharge mechanism is characterized in a fixed hollow pipe set having an upper and a lower intakes with an inner lining member disposed therein, which is associated with a pair of internally disposed control petals; and a couple of float valves are pivotably mounted to the outside of the fixed pipe set; and a pair of control buttons protruding out of the top cover of the flush toilet tank are operatively associated with the control petals by linkage. The control buttons effect the operation of the control petals by actuation arms so as to assure the float valves can float to open the water intakes. Thus the water can be selectively discharged at different volume levels.

DESCRIPTION OF THE PRIOR ART

As shown in FIG. 7, a common conventional water saving flush toilet is equipped with a 2-stage press handle. However, such water saving outlet 2 is still designed in a traditional manner, employing a buoy 21 fixed on a curved arm 211 pivotably mounted onto a fixed set 22 so as to control a suspending arm 23 pivotably connected to the fixed set 22. The sealing petal 24 is able to make the outlet 221 firmly sealed after water is discharged. The hand operated press handle 26 is operatively connected to the pull string 25 which is associated with the suspending arm 23 so to effect the movement of string 25 as well as the suspending arm 23. Since the press handle 26 can control the travel distance of string 25 which will then determine the degree of the opening of the petal 24 moved by the suspending arm 23 with respect to the outlet 221, thereby water discharge can be varied; but there are a number of disadvantages in association with the type of prior art using a single press handle to effect two stages of water discharge, which are listed as follows:

1. In practice, an operator is not given instructions of how to operate the two stages of water discharge, in most cases, more often than not, only one stage of water discharge is made.

2. To provide a maximum of water discharge, the press handle must be depressed via the first stage then the second stage, it is relatively inconvenient in accurately controlling water discharge.

3. The water-stopping petal sealing against the water entrance is controlled by the suspending arm which is pivotably fixed on a stationary mount and is suppressed by the curved arm of the buoy. It is often the case that the curved arm abuts against the suspending arm at a number of different positions, resulting in the offset of the petal against the outlet; thus excessive abrasion and poor sealing are easily caused.

4. The operation to discharge water by releasing the suspending arm from the pressing curved arm of the buoy is effected by leverage wherein the string is pulled as a result of a short actuation arm actuating a long arm; this is a relatively force requiring operation.

SUMMARY OF THE INVENTION

The primary object of the present invention is to provide a 2-stage controllable water discharge mechanism which is equipped with a pair of vertically spaced water intakes each controlled by a float valve, and one or both of which can be opened for selectively discharging varied volumes of water to flush a toilet.

The other object of the present invention is to provide a two-stage controllable water discharge mechanism having a pair of water intakes each of which is equipped with a float valve movable in constant parallel with the vertical surface of the intakes in opening or closing operation so as to reduce the frictional abrasion of the valves.

One further object of the present invention is to provide a two-stage controllable discharge mechanism which adopts buoyant force to operate the float valves for effecting the opening and closing of the water outlets.

To better illustrate the structure and operation mode and the features of the present invention, a number of drawings are given in company with a detailed description thereof, in which:

DETAILED DESCRIPTION OF THE PREFERRED EMBODIMENT

Figure 1:
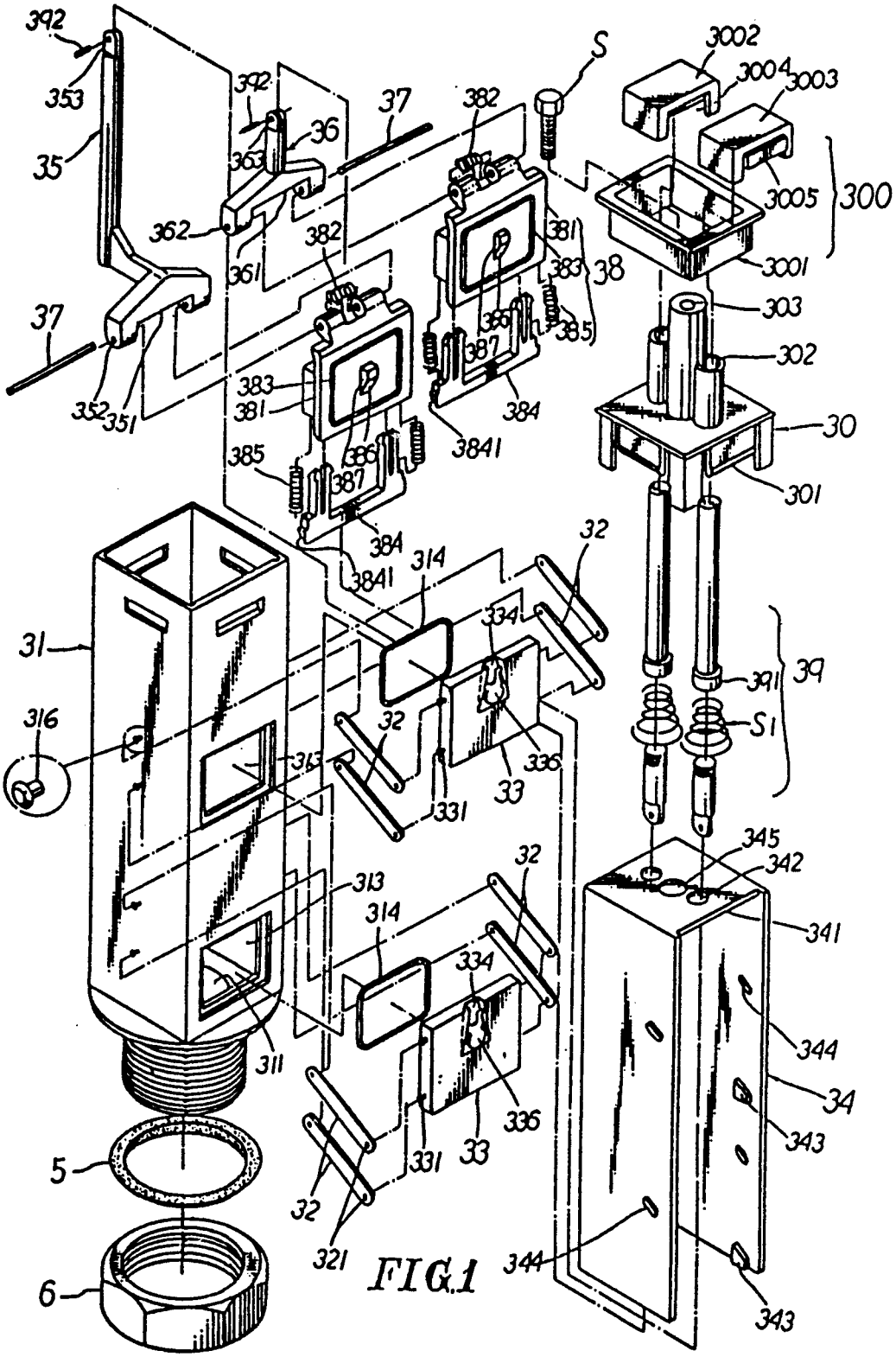
FIG. 1 is a perspective view showing the exploded components of the present invention.
Figure 2:
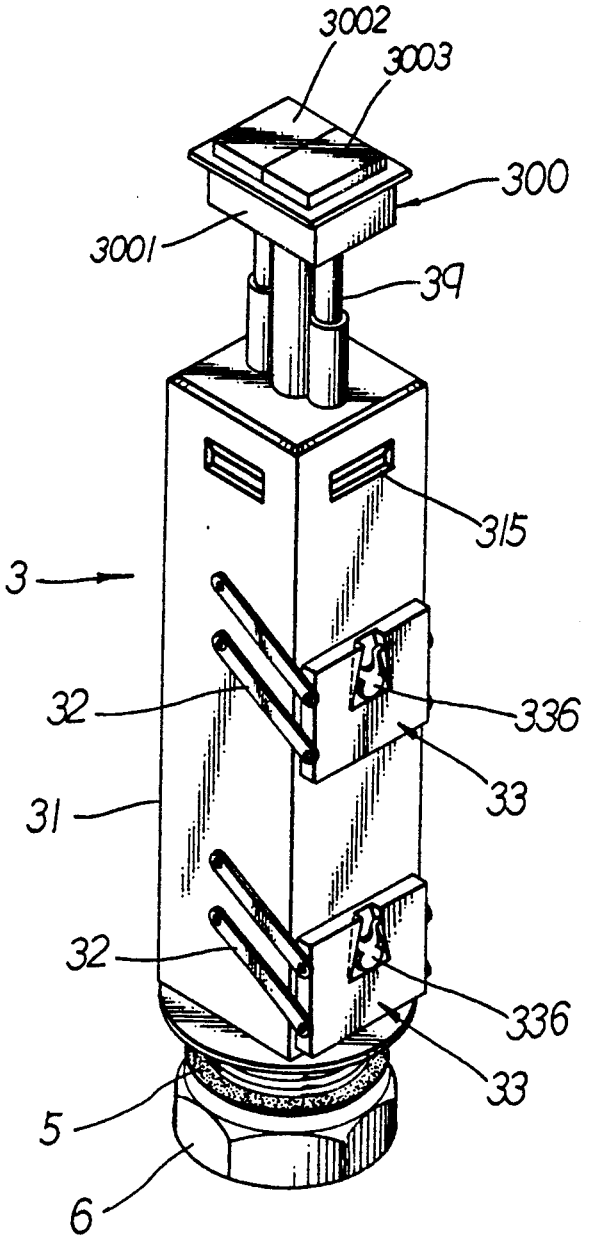
FIG. 2 is a diagram showing the assembly of the present invention.

As shown in FIGS. 1, 2, the present water outlet mechanism 3 is illustrated with its exploded components assembled and disassembled separately, and the same is mainly comprised of a hollow pipe shaped fixed set 31 having a water outlet 311 at the bottom end and an externally threaded tube extended downward therefrom; and a pair of water intakes 313 are disposed at one face of the fixed set with a distance defined therebetween; one of a pair of seals 314 is disposed in association with the intakes 313 respectively; a slot 315 is disposed on each face of the fixed set 31 at the top end thereof.

There are four pairs of connecting levers 32 each one of which is provided with a hole 321 at each end thereof and engaged with one of a pair of protrusion rods 316 so that the connection levers 32 can be pivotably moved up and down in parallel with the face of the fixed set 31.

A pair of float valves 33 having a hollow interior and made in rectangular or any suitable shape and is provided with a pair of protrusions on each of the opposite sides thereof so that it can be pivotably associated with the connecting 32 which are pivotably engaged with the fixed set 31. The float valves 33 are disposed in association with the water intakes 313. On the inner side of each float valve 33 is disposed an escape recess 333, and a slanted recess 334 is defined on the opposite side, i.e., the front side thereof; and a through hole is disposed to permit communication of the recess 333 and recess 334 with a seal piece 335 engaged therewith; a pivotable sealing lid 336 having an extended rod 337 on the reverse side thereof is pivotable disposed in the slanted recess 334 with the extended rod 337 going through the seat piece 335 and extending into the escape recess 333 so that the seal lid 336 can seal against the seal piece 335. The density of the float valve 33 is smaller than water, so the same can be buoyant when plunged in water; thereby the same can be raised about the connecting rods 32 and dropped due to its own weight to seal the water intake 313.

A U-shaped inner lining member 34 is mounted in engagement with the fixed set 31; on the top thereof is disposed a stop edge 341 and a pair of through holes 342. On each of the opposite inner walls thereof are disposed a pair of slanted guide members 343 at the middle and the bottom respectively thereof, and a pair of slanted slots 344 are disposed on each of the opposite sides thereof with each above the guide member 343 respectively; and an overflow hole 345 is located right between the through holes 342.

A long pivot arm 35 and a short pivot arm 36 are equipped respectively with a C-shaped unit 351 and 361 which are provided with a pair of through holes 352 and 362 respectively so that the arm 35 and 36 are able to be located inside the inner lining member 34 with the control petal pivotably attached thereto by a pin member 37 respectively which is located with its ends in the slanted slots 344. The top end of the arm 35 and arm 36 are disposed respectively a pin hole 353 and 363 so that the arms can be pivotably connected to the actuation arms.

A couple of control petals 38 having a petal body 381 are pivotably connected to the long pivot arm 35 and the short pivot arm 36 by engaging the same to the C-shaped units 351, 361 respectively; and the control petals 38 are resiliently limited by a spring member 382. The control petals are disposed inside the fixed set 31 with the same closely abutting against the water intakes 313, and a seal ring 383 is attached to the face of each control petal 38. A $\pi$-shaped guide element 384 having a slanted guide face 3841 is attached to the bottom of the respective control petal body 381 with springs 385 fixed therebetween. One the front face of the petal body 381 is disposed a protrusion 387 having a slanted slide face 386 and is in abutment with the extended rod 337. The protrusion 387 and the slanted slide face 386 function to push the sealing lid 336 open.

A pair of actuation arms 39 are either integrally fabricated or are made into two sections joined together whereby the length thereof can be adjusted; the middle of each arm 39 is provided with a cylindrical bulge 391 so that another section can be threadedly attached thereto. Each actuation arm 39 is guided first through the through hole 342 of the inner lining member 34 and is engaged with the long or short pivot arm 35 or 36 respectively by pin 392, and a spring S1 is disposed beneath the cylindrical bulge.

A cover 30 having four downward extended engagement walls 301 corresponding to and in register with the four slots 315 to thereby engage the fixed set 31. Two extended tubular elements 302 for the reception of the actuation arms 39 are disposed on the top of the cover 30; and a projection rod disposed between the two tubular elements 302 is provided with a threaded hole 303 at the top end thereof.

A control button set 300 consists of a button mounting seat 3001 having three through holes 3006 defined at the bottom thereof, permitting the passing of the two tubular elements 302 and the projection rod of the fixed hollow pipe set cover 30; and a pair of buttons 3002, 3003 which are engaged with the button mounting seat 3001 are provided with a concavity 3004 and a side bulge 3005 so that the same can be engaged with the actuation arms 39 and drives the arms 39 to move downward.

Figure 3:
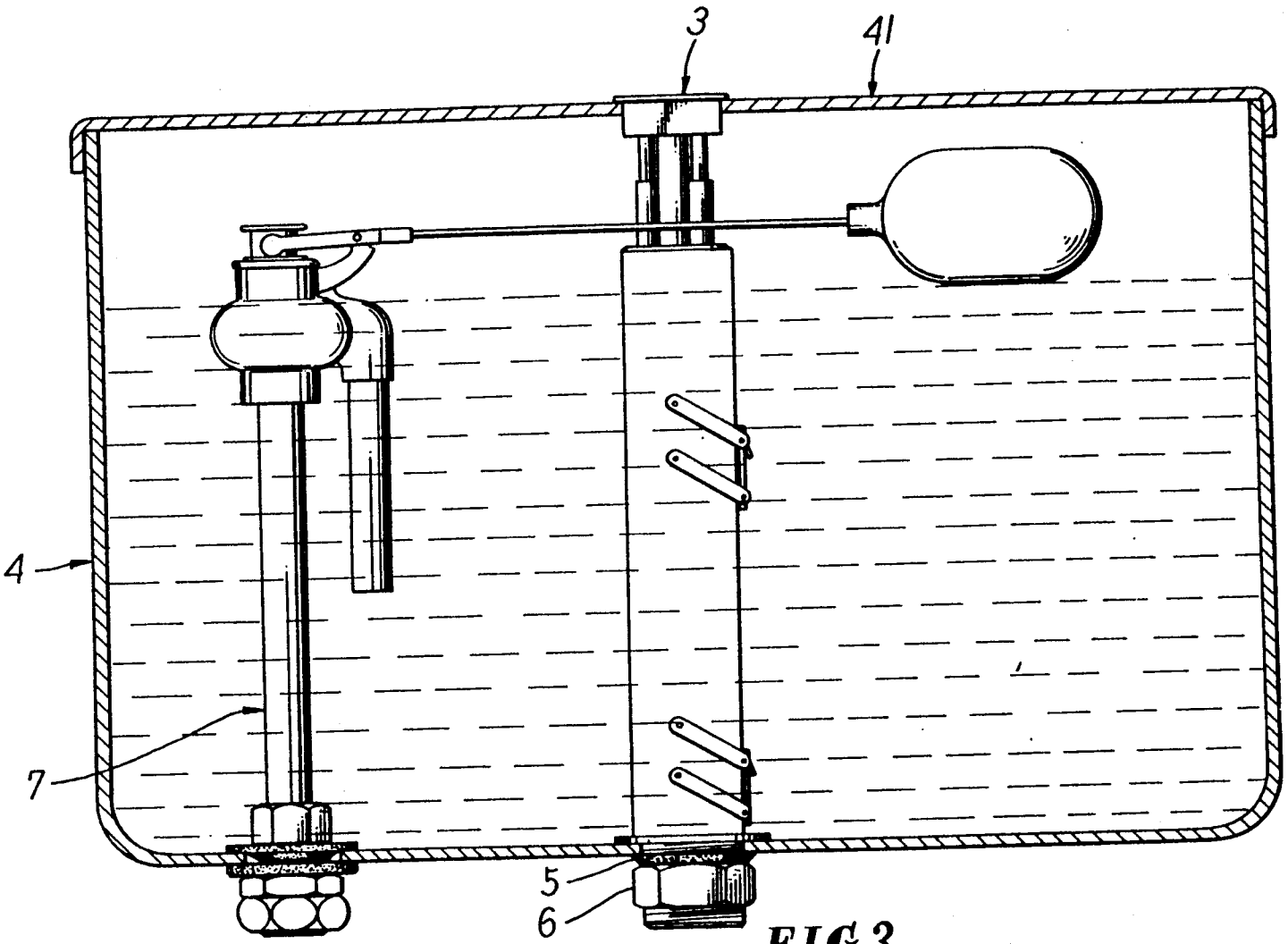
FIG. 3 is a sectional view of a cistern equipped with the present water discharge mechanism.
Figure 4:
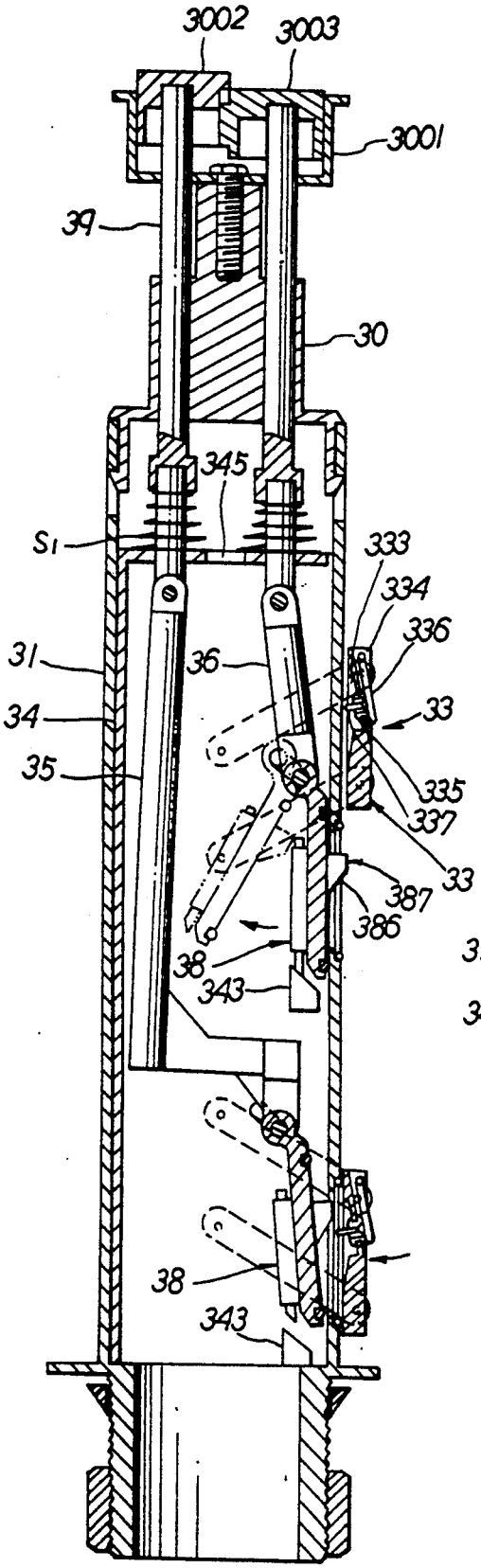
FIG. 4 is a diagram showing the operation of small-volume discharge of water in the present invention.
Figure 5:
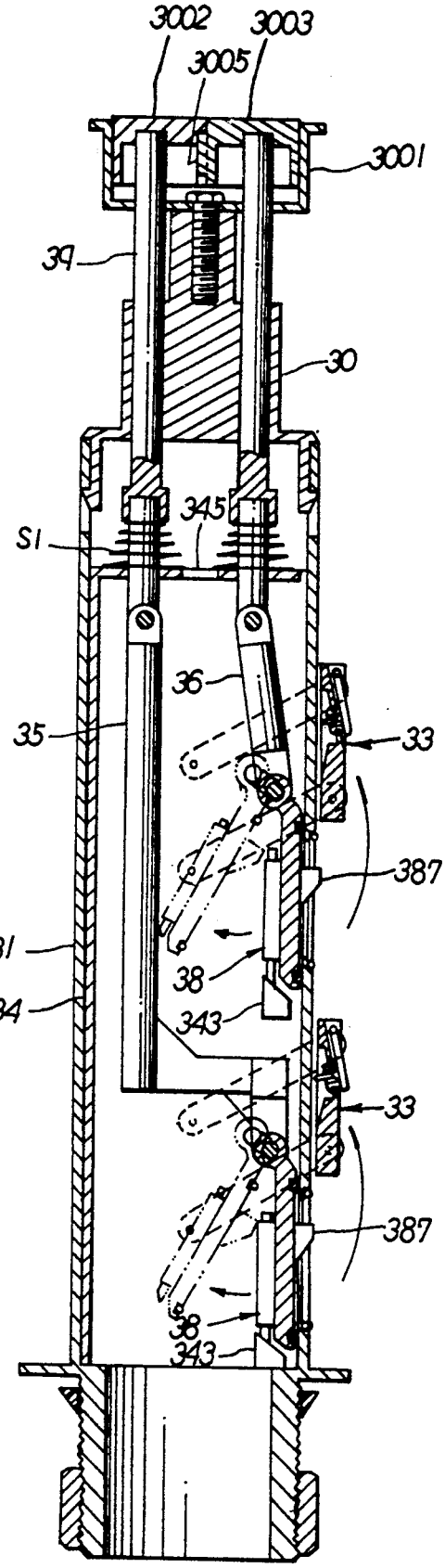
FIG. 5 is a diagram showing the operation of large-volume discharge of water in the present invention.

The two-stage controllable water discharge mechanism 3 is secured to the bottom of the conventional cistern 4 by engaging the bottom end of the fixed set 31 therewith by means of a seal ring 5 and a nut 6, as shown in FIG. 3; and the control button mounting seat 3001 is attached to the cistern cover 41 by engaging a screw S with the threaded hole 303 of the fixed hollow pipe set cover 30, and the actuation arm 39 is guided through the button mounting seat 3001 and is coupled to the buttons 3002 and 3003. So when the cistern 4 is filled with water, to provide maximum discharge of water, an operator must actuate both the control buttons 3002 and 3003 to drive the long pivot arm 35 and short pivot arm 36 to move downward and further actuate the control petals 38 to seal against the water intakes 313 as a result of the petals 38 abutting against the guide members 343 disposed on the inner walls of the inner lining member 34 with the protrusions 387 and the slanted slide faces 386 of the petals 38 urging against the extended rods 337 of the sealing lids 336 so as to push the sealing lids 336 of the float valves 33 open, permitting the water in the cistern to flush into the intakes 313 and make the float valves become buoyant and move upward. Thus the sealing of the intakes 313 is removed, as shown in FIGS. 4, 5. When the operator releases the buttons, the spring S1 will force the actuation arms 39 to lift up and the control petals 38 are pivoted upward to wide open due to the in- flush of water accordingly, as shown in FIGS. 4, 5 by dotted lines. The selection of pushing one button or both buttons can determine the volume of water discharge into the toilet bowl.

Figure 6:
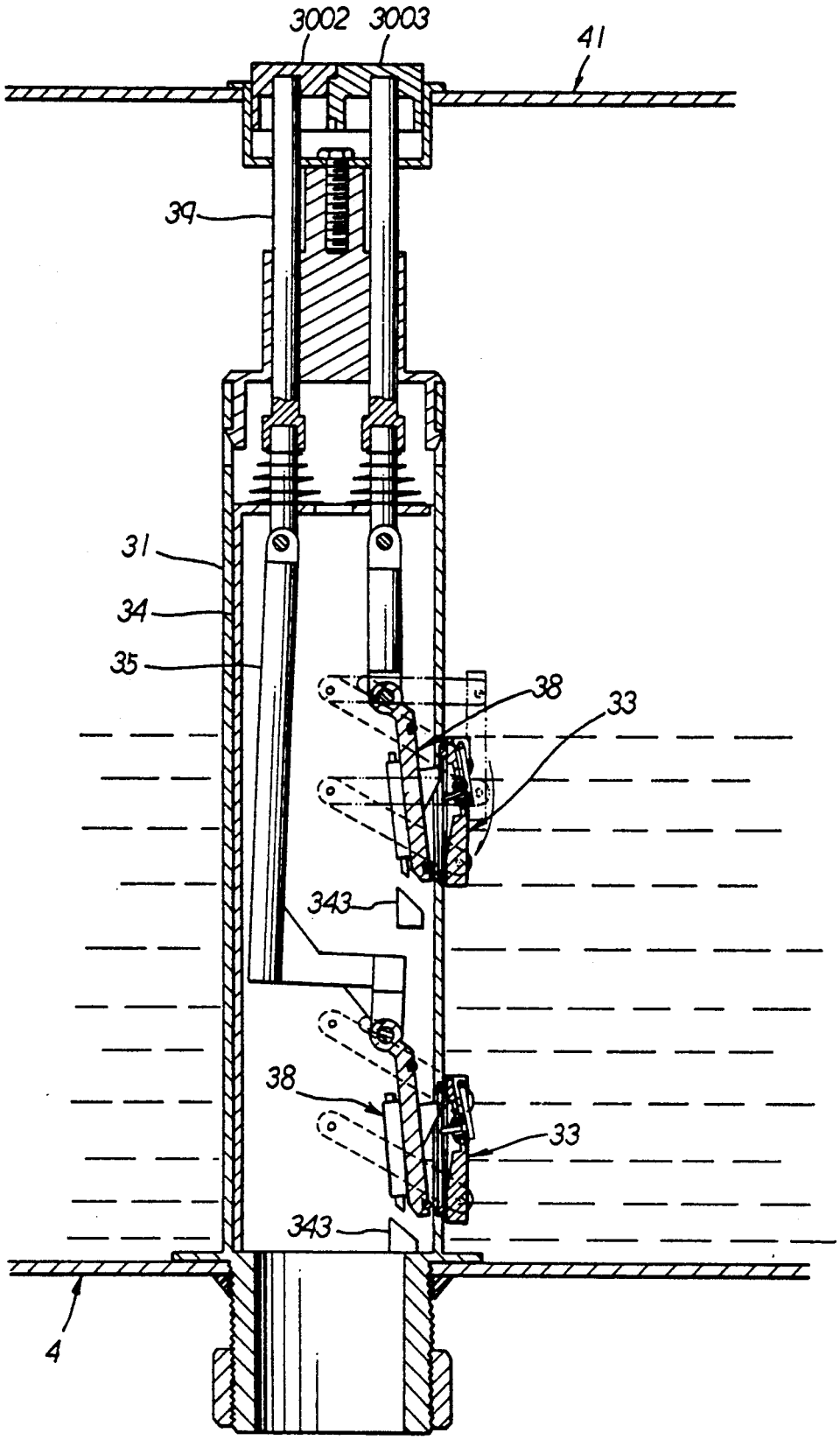
FIG. 6 is a diagram showing the termination of water discharge in the present invention.
Figure 7:
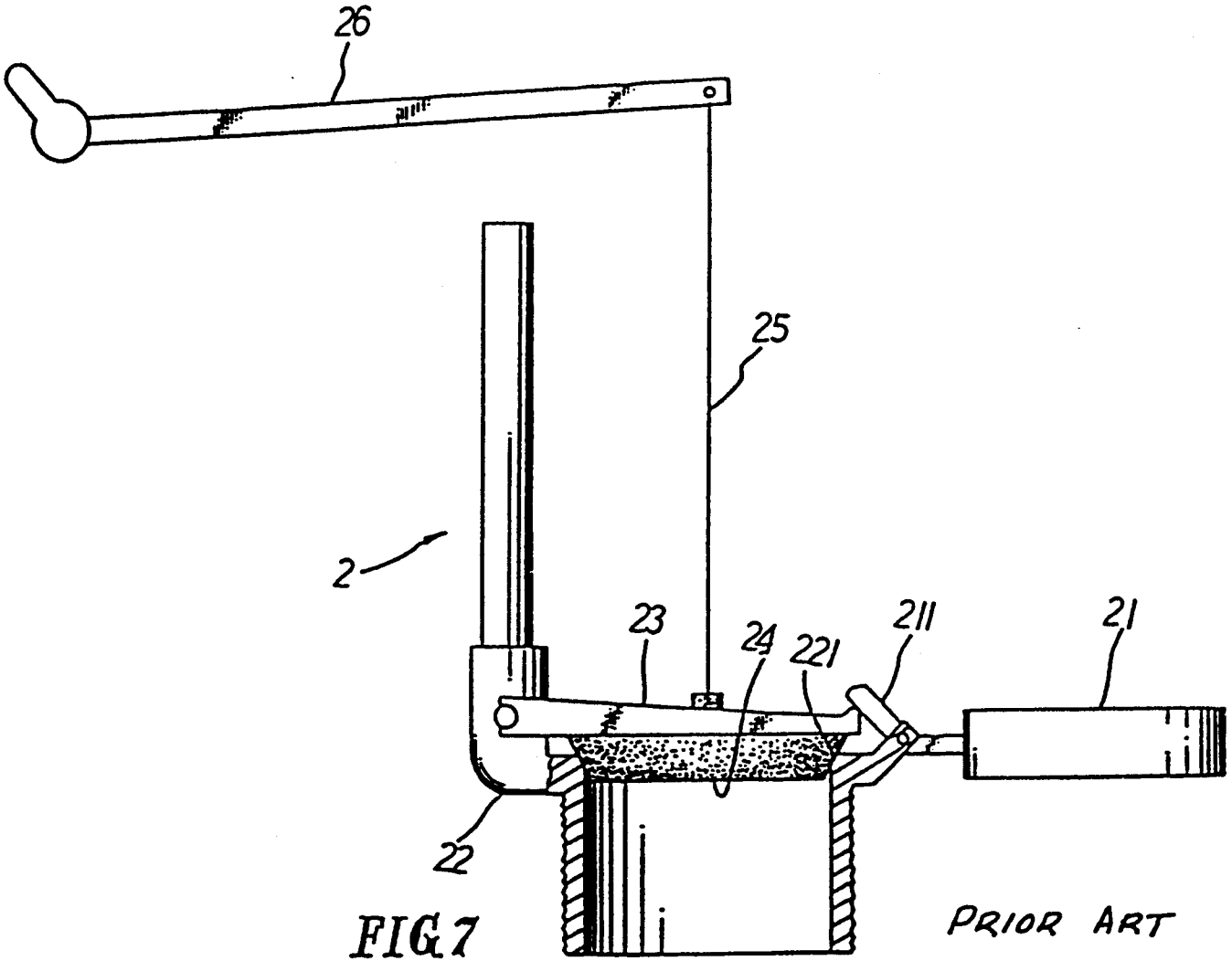
PRIOR ART FIG. 7
FIG. 7 is a diagram showing the conventional type of water discharge mechanism.

Furthermore, in case of one button being pushed, when the water level drops below half of the vertical length of the upper water intake 313 with water continuing to flow out, the float valve 33 will drop along the discharged water to close the water intake 313 as shown in FIG. 6, newly filled water will help to push the float valve 33 to seal against the intake 313 more tightly; at the same time, the control petal 38 will resume to its non-operational position and water will be nuturally sealed.

Moreover, between the petal body 381 and the guide element 384 of each control petal 38 are disposed a pair of springs 385 so that when the control petal 38 moves downward, the guide element 384 will first abut against the guide members 343 disposed on the inner walls of the inner lining member 34, then the control petal 38 is led to its proper position with the springs compressed; when the operator releases the control button set 300, the petal body 381 escapes from the restraint and will be lifted up by the long and short pivot arms 35, 36 and the springs 384. Thus the whole control petal 38 is smoothly brought to its nonoperational position.

It is apparent that the present invention is easily operable and structured differently from the conventional water discharge mechanism; the advantages thereof are given as below:

1. The volume of discharged water can be easily selected by using the control petals to effect the selection of number of operation of the float valves.

2. The whole operation performed by the control buttons is easy and effective.

3. The control petal is used to force the float valve to open and buoy, and the operation is very simple and efficient.

4. The float valves are pivotably moved in parallel with the water intakes by means of a pair of connecting sticks so that no frictional abrasion is caused to avoid leakage after a long term of use.

The foregoing description of the specific embodiments will so fully reveal the general nature of the invention that others can, by applying current knowledge, readily modify and/or adapt for various applications and specific embodiments without departing from the generic concept, and therefore such adaptations and modifications are intended to be comprehended within the meaning and range of equivalents of the disclosed embodiments. It is to be understood that the phraseology or terminology herein is for the purpose of description and not of limitation.

I claim:

1. An improved two-stage controllable water discharge mechanism for a flush toilet tank comprising:

a hollow pipe fixed set having a rectangular opening at the lower end thereof with an externally threaded discharge tube extended downward from the bottom thereof; and a pair of water intakes disposed at one face thereof with a predetermined distance defined therebetween;

a pair of seals each of which is disposed in association with said water intakes;

a couple of paired protrusion rods disposed on the opposite sides of said fixed set with the side having said intakes disposed in connection therewith, and each pair of said rods positioned at the same height as said water intakes;

a slot disposed on each face of said fixed pipe at the top end thereof; a pair of float valves having a hollow interior, each said valve provided with a pair of protrusions on each of the opposite sides thereof so that the same can be pivotably associated with said hollow pipe fixed set by connecting levers to seal against said water intakes; the inner side of each said float valve disposed with an escape recess and a slanted recess defined on the opposite side thereof with a through hole disposed therebetween to permit therebetween communication thereof; and a seal piece disposed in association therewith;

a pivotable sealing lid having an extended rod on the reverse side thereof pivotably disposed in said slanted recess with said extended rod going through the seal piece and into said escape recess so that the seal lid seals against said seal piece;

each said float valve having a density less than the density of water so that the same is buoyant in water and drops due to its own weight when not in water;

a U-shaped inner lining member mounted in engagement with said hollow pipe fixed set; a stop edge and a pair of through holes disposed on the top of said U-shaped inner lining member; a pair of slanted guide members disposed on each of the opposite inner walls of said inner lining member at the middle and bottom portions thereof a pair of slanted slots disposed adjacent to said guide members; an overflow hole being disposed between said through holes;

a long pivot arm and a short pivot arm each provided with a C-shaped unit to which the control petal is pivotably associated by a pin member having two ends slidably disposed in said slanted slots on said inner lining member; a pin hole disposed in the top end of each said pivot arm for connection to actuation arms;

a couple of control petals each having a petal body pivotably connected to said long and short pivot arms; each said control petal resiliently limited by a spring member; said control petals disposed inside said hollow pipe fixed set with the same closely abutting against the water intakes; and a seal ring attached to the face of each control petal; a $\pi$-shaped guide element having a slanted guide face attached to said bottom of the respective control petal body with springs fixed a protrusion having a slanted slide face disposed on the front face of each said petal body and in operation;

a pair of actuation arms disposed through said through holes of said inner lining member and pivotably engaged with said long and short pivot arms by pins; a spring being used to enable each said actuation arm to be resiliently operated;

a cover having four downward extended engagement walls in register with said four slots of said hollow pipe fixed set so that the cover is engaged therewith; two extended tubular elements for reception of said actuation arms disposed on the top of said cover; a projection rod disposed between said two tubular elements and having a threaded hole at the top end thereof;

a control button set having a button mounting seat provided with three through holes at the bottom thereof to permit the passing of said two tubular elements and said projection rod of said cover; and a pair of buttons engaged with said mounting seat and said actuation arms whereby an operator can effect the actuation of said actuation arms;

said hollow pipe-shaped fixed set secured to a cistern with said easy control buttons exposed outside the cover of said cistern for easy operation.

2. An improved two-stage controllable water discharge mechanism as claimed in claim 1 wherein each said actuation arm comprises two sections each said actuation middle of the arm provided with a cylindrical bulge whereby the respective sections of each actuation arm are attached to each other and whereby the length of each said actuation arm can be adjusted.

3. An improved two-stage controllable water discharge mechanism as claimed in claim 1 wherein said petal body and said guide element of each said control petal are integrally fabricated.

* * * * *